United States Patent [19]

Juelg, Jr.

[11] 4,100,622

[45] Jul. 18, 1978

[54] SHIRT CONSTRUCTION

[76] Inventor: James Edwin Juelg, Jr., 4514 Hamlin, Corpus Christi, Tex. 78411

[21] Appl. No.: 718,477

[22] Filed: Aug. 30, 1976

[51] Int. Cl.[2] ..... A41D 27/20

[52] U.S. Cl. ..... 2/115

[58] Field of Search ..... 2/115, 117, 106, 108, 2/109, 111, 113

[56] References Cited

U.S. PATENT DOCUMENTS

| | | | |
|---|---|---|---|
| 1,302,108 | 4/1919 | Wetzel | 2/108 |
| 1,459,747 | 6/1923 | Redmond | 2/111 |

*Primary Examiner*—Doris L. Troutman

*Attorney, Agent, or Firm*—G. Turner Moller

[57] ABSTRACT

There is disclosed a shirt in which the lower portion thereof resides between the belt line and a thigh of the wearer. One or more flaps are provided on the sides of the shirt allowing easy access to the pants pocket when the shirt is worn outside the pants.

7 Claims, 7 Drawing Figures

SHIRT CONSTRUCTION

This invention relates to wearing apparel and more particularly to upper body garments known as shirts. Although most shirts are designed to be tucked into the pants of the wearer, some shirts, notably sport shirts, are often not tucked in and accordingly overlap the upper portion of the wearer's trousers. When so worn, it will be apparent that the shirt tail covers the entrance to the front pants pockets. To gain access to the pants pockets, the wearer must hike up the shirt tail and then extend the hand into the pocket.

Of some interest relative to this invention are the disclosures in U.S. Pat. No. 1,056,604 and 3,000,012.

It is an object of this invention to provide a shirt construction having one or more flaps adjacent the lower periphery thereof which facilitate access to the pants pocket when the shirt is not tucked into the trousers of the wearer.

In summary, the apparel of this invention comprises a shirt including a torso encircling portion having a front, a back and a pair of sides; and a lower peripheral edge residing between the belt line and the thigh of a wearer, the peripheral edge having a pair of reentrant slots, on a side of the torso encircling portion, defining a flap therebetween, the flap being positioned to overlie an entrance to a pocket on the pants of a wearer.

IN THE DRAWING

Figure 1:
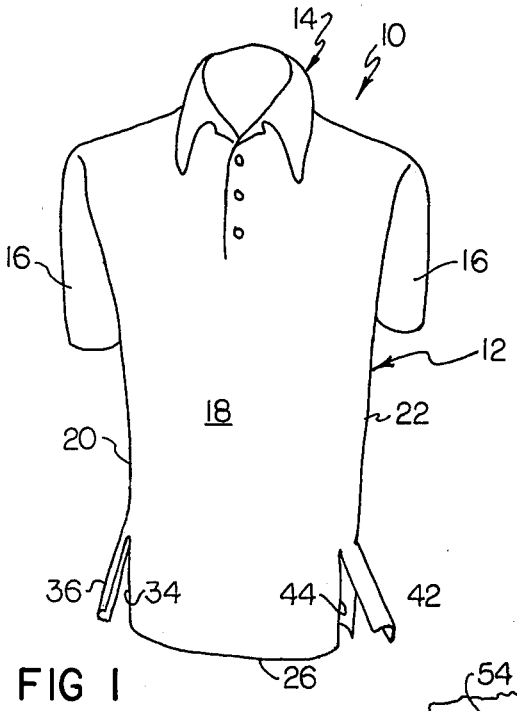
FIG. 1 is a pictorial view of a shirt embodying the principles of this invention.

Referring to FIG. 1, there is illustrated an upper body garment or shirt 10 comprising a torso encircling portion 12, a collar 14 and a pair of sleeves 16.

The torso encircling portion 12 includes, as is customary, a front 18, a pair of sides 20, 22, and a back 24. The torso encircling portion 18 also comprises a lower peripheral edge 26 which resides in a plane 28 between a belt line 30 and a thigh 32 of a wearer. The peripheral edge 26 comprises a pair of spaced reentrant slots 34 on the side 20 of the torso encircling portion 12.

Figure 2:
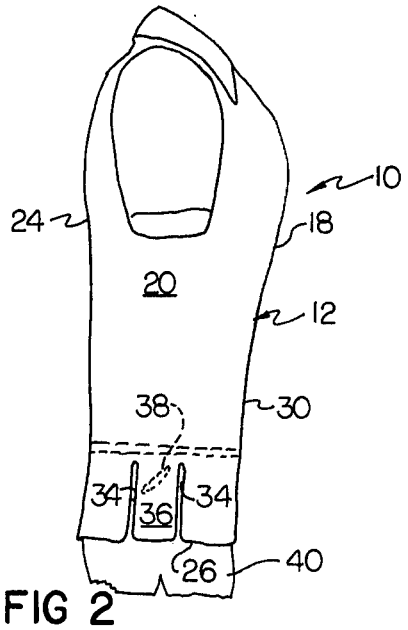
FIG. 2 is a side view of the shirt of FIG. 1 illustrating the shirt overlying the top of the wearer's pants.
Figure 3:
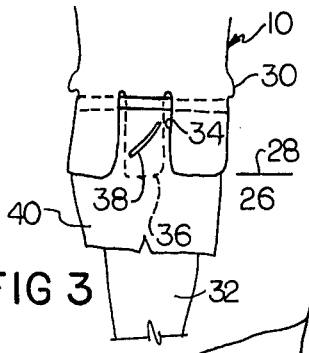
FIG. 3 is a partial side view of an individual wearing the shirt of this invention partially tucked into a pair of pants.
Figure 4:
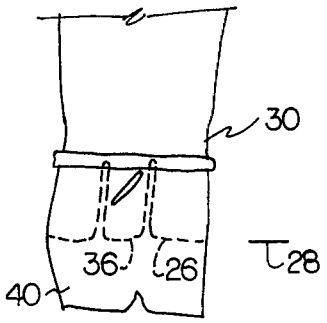
FIG. 4 is a view similar to FIG. 3 illustrating the shirt of this invention worn on the inside of the wearer's pants.

As shown most clearly in FIGS. 2 and 4, the flap 36 overlies the opening 38 of a front pocket of the pants 40. It will be apparent that the slots 34 are conveniently substantially parallel and terminate slightly below the belt line 30 as suggested in FIG. 4. As shown in FIG. 3, the flap 36 may be tucked into the pants 40 to provide easy access to the pocket opening 38. It will be apparent that the shirt 10 is somewhat loosely tucked into the pants in the illustration of FIG. 3 to allow the end of the slots 34 to reside at the belt line 30.

With the shirt 10 worn outside the pants 40 of the wearer, it will be apparent from FIG. 2 that easy access to the pocket opening 38 is provided since the wearer's hand can be readily moved through the rearmost slot 34 or the flap 36 can be readily raised.

Referring to FIG. 1, the shirt 10 may be provided with a second flap 42 defined by similar reentrant slots 44 thereby providing ready access to the front pocket on either side of the pants 40.

Figure 5:
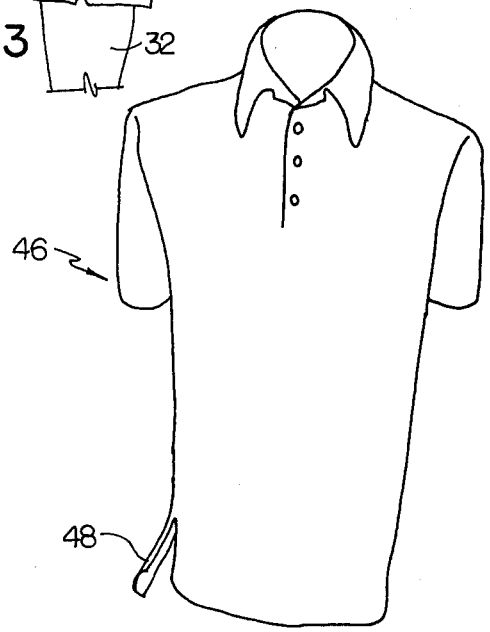
FIG. 5 is a view similar to FIG. 1 illustrating a flap on only the right side of the shirt.

Referring to FIG. 5, there is illustrated a shirt or upper body garment 46 which is substantially identical to the shirt 10 except that only a single flap 48 is provided on the right side of the shirt 46.

Figure 6:
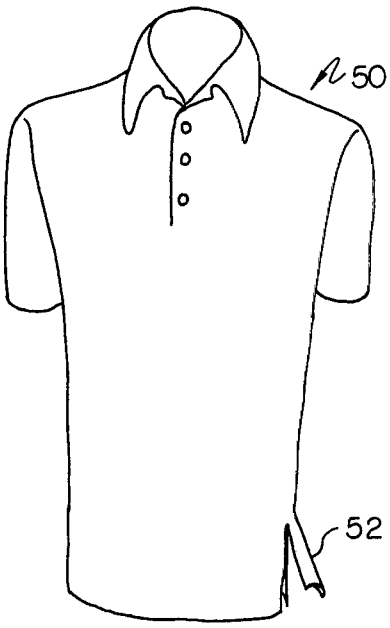
FIG. 6 is a view similar to FIGS. 1 and 5 illustrating a flap only on the left side of the shirt.

As shown in FIG. 6, a shirt 50 may be provided having a single flap 52 on the left side thereof.

Figure 7:
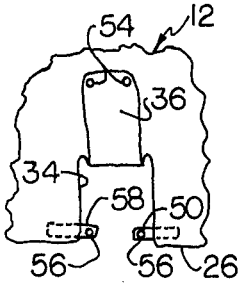
FIG. 7 is a partial view of the junction between the flap end and the shirt illustrating one means of temporarily connecting the flap end to the shirt periphery.

Referring to FIG. 7, there is illustrated a convenient technique for temporarily connecting the free end of the flap 36 to the main portion of the shirt 10. The flap 36, adjacent the free end thereof, is provided with one or more snap halves 54. Mating snap halves 56 are secured by material strips 58 to the torso encircling portion 12 in any convenient manner, as by sewing. It will be apparent that the flap 36 may be temporarily connected to the torso encircling portion 12 as desired. It will also be apparent that other suitable means may be used to temporarily connect the flap 36 to the torso encircling portion 12, such as zippers, buttons, Velcro fasteners and the like.

The length of the slots 34 and consequently the length of the flap 36 are dictated by the length of the shirt 10 below the wearer's belt line 30. Thus, if the shirt tail is rather short, the slots 34 are rather short. Similarly, if the shirt tail is rather long, the slots 34 are rather long. In practice, it has been found that the slots 34 are usually 2–12 inches in length and perferably are 3–8 inches in length.

I claim:

1. An article of apparel comprising a shirt substantially larger than infant size providing a torso encircling portion having a front, a back and a pair of sides; and a lower peripheral edge residing between the belt line and the thigh of a wearer, the peripheral edge having a pair of reentrant slots, on a side of the torso encircling portion, defining a flap therebetween, the flap being positioned to overlie a pocket on the pants of a wearer and being freely liftable to provide access to said pocket.

2. The shirt of claim 1 wherein the peripheral edge provides a second pair of reentrant slots, on the other side of the torso encircling portion, defining a second flap therebetween, the second flap being positioned to overlie a second pocket on the pants of a wearer.

3. The shirt of claim 2 wherein the lower peripheral edge resides in a plane when worn by a wearer.

4. The shirt of claim 1 wherein the reentrant slots are substantially parallel.

5. The shirt of claim 1 wherein the reentrant slots terminate adjacent the belt line of the wearer.

6. The shirt of claim 1 wherein the reentrant slots are substantially identical and are in the range of 3–8 inches in length providing a flap of 3–8 inches in length.

7. An apparel ensemble, comprising a lower body garment comprising a waist band and a body encircling portion connected thereto having at least one pocket opening through a side of the garment; and a shirt providing a torso encircling portion having a front, a back and a pair of sides; and a lower peripheral edge residing between the waist band and the thigh of a wearer, the peripheral edge having a pair of reentrant slots, on a side of the torso encircling portion straddling the opening of the pocket, defining a flap therebetween, the flap being positioned to juxtapose the opening of the pocket and unconnected with the lower body garment.

* * * * *